US008772683B2

(12) United States Patent
Parsche

(10) Patent No.: US 8,772,683 B2
(45) Date of Patent: Jul. 8, 2014

(54) APPARATUS AND METHOD FOR HEATING OF HYDROCARBON DEPOSITS BY RF DRIVEN COAXIAL SLEEVE

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 549 days.

(21) Appl. No.: 12/878,774

(22) Filed: Sep. 9, 2010

(65) Prior Publication Data

US 2012/0061380 A1 Mar. 15, 2012

(51) Int. Cl.

| | |
|---|---|
| ***H05B 6/00*** | (2006.01) |
| ***H05B 6/62*** | (2006.01) |
| ***E21B 36/04*** | (2006.01) |
| ***E21B 43/24*** | (2006.01) |

(52) U.S. Cl.

CPC ..... *E21B 43/2401* (2013.01); *H05B 6/62* (2013.01); *H05B 2214/03* (2013.01); *E21B 36/04* (2013.01)

USPC ..... 219/618

(58) Field of Classification Search

USPC ..... 219/618; 166/248, 335, 244.1, 256, 57; 392/301, 310

See application file for complete search history.

(56) References Cited

U.S. PATENT DOCUMENTS

| | | | |
|---|---|---|---|
| 2,371,459 | A | 3/1945 | Mittelmann |
| 2,685,930 | A | 8/1954 | Albaugh |
| 3,497,005 | A | 2/1970 | Pelopsky |
| 3,848,671 | A | 11/1974 | Kern |
| 3,954,140 | A | 5/1976 | Hendrick |
| 3,988,036 | A | 10/1976 | Fisher |
| 3,991,091 | A | 11/1976 | Driscoll |
| 4,035,282 | A | 7/1977 | Stuchberry et al. |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

Portland Cement Association, Portland Cement Association Sustainable Manufacturing Fact Sheet, Iron and Steel Byproducts, Jul. 2005.*

(Continued)

*Primary Examiner* — Dana Ross
*Assistant Examiner* — Renee L Miller
(74) *Attorney, Agent, or Firm* — Allen, Dyer, Doppelt, Milbrath & Gilchrist, P.A.

(57) ABSTRACT

An apparatus for radiating RF energy from a well structure that provides a circuit through which RF power may be driven to heat a hydrocarbon deposit that is susceptible to RF heating. The apparatus includes a source of RF power connected at one connection to a conductive linear element, such as a well bore pipe, and at a second connection to a conductive sleeve that surrounds and extends along the linear conductive element. The sleeve extends along the linear conductive element to a location between the connection of the source of RF energy to the linear conductive element and an end of the linear conductive element where the sleeve is conductively joined near to the linear conductive element. The apparatus may include a transmission section that extends from a geologic surface to connect to a radiating apparatus according to the invention.

27 Claims, 7 Drawing Sheets

(56) References Cited

U.S. PATENT DOCUMENTS

| | | | | |
|---|---|---|---|---|
| 4,042,487 | A | 8/1977 | Seguchi | |
| 4,087,781 | A | 5/1978 | Grossi et al. | |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges et al. | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A * | 4/1985 | Heeren | 166/248 |
| 4,513,815 | A * | 4/1985 | Rundell et al. | 166/57 |
| 4,514,305 | A | 4/1985 | Filby | |
| 4,524,827 | A | 6/1985 | Bridges | |
| 4,531,468 | A | 7/1985 | Simon | |
| 4,553,592 | A * | 11/1985 | Looney et al. | 166/248 |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,100,259 | A * | 3/1992 | Buelt et al. | 405/128.65 |
| 5,136,249 | A | 8/1992 | White | |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A | 4/1994 | McGaffigan | |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,106,895 | A | 8/2000 | Usuki | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,303,021 | B2 | 10/2001 | Winter | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Tsujimura | |
| 6,649,888 | B2 | 11/2003 | Ryan et al. | |
| 6,712,136 | B2 | 3/2004 | de Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 2002/0032534 | A1 | 3/2002 | Regier | |
| 2004/0031731 | A1 | 2/2004 | Honeycutt | |
| 2004/0211554 | A1 | 10/2004 | Vinegar et al. | |
| 2005/0040991 | A1 * | 2/2005 | Crystal | 343/747 |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin et al. | |
| 2009/0242196 | A1 | 10/2009 | Pao | |
| 2011/0309988 | A1 | 12/2011 | Parsche | |

FOREIGN PATENT DOCUMENTS

| | | | |
|---|---|---|---|
| DE | 10 2008 022176 | A1 | 11/2009 |
| EP | 0 135 966 | | 4/1985 |
| EP | 0418117 | A1 | 3/1991 |
| EP | 0563999 | A2 | 10/1993 |
| EP | 1106672 | A1 | 6/2001 |
| FR | 1586066 | A | 2/1970 |
| FR | 2925519 | A1 | 6/2009 |
| JP | 56050119 | A | 5/1981 |
| JP | 2246502 | A | 10/1990 |
| WO | WO 2007/133461 | | 11/2007 |
| WO | WO2008/011412 | A2 | 1/2008 |
| WO | WO 2008/030337 | | 3/2008 |
| WO | WO2008098850 | A1 | 8/2008 |
| WO | WO2009027262 | A1 | 8/2008 |
| WO | WO2009/114934 | A1 | 9/2009 |

OTHER PUBLICATIONS

PCT Notification of Transmittal of the International Search Report and The Written Opinion of the International Searching Authority, or the Declaration, in PCT/US2010/025761, dated Feb. 9, 2011.

PCT Notification of Transmittal of the International Search Report and The Written Opinion of the International Searching Authority, or the Declaration, in PCT/US2010/057090, dated Mar. 3, 2011.

"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).

Von Hippel, Arthur R., Dielectrics and Waves, Copyright 1954, Library of Congress Catalog Card No. 54-11020, Contents, pp. xi-

(56) References Cited

OTHER PUBLICATIONS xii; Chapter II, Section 17, "Polyatomic Molecules", pp. 150-155; Appendix C-E, pp. 273-277, New York, John Wiley and Sons.
U.S. Appl. No. 12/886,338, filed Sep. 20, 2010 (unpublished).
Butler, R.M. "Theoretical Studies on the Gravity Drainage of Heavy Oil During In-Situ Steam Heating", Can J. Chem Eng, vol. 59, 1981.
Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.
Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.
Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Stresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagentic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COSMOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S. Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery From Thin Pay Zones by Electromagentic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diel, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Resevoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil Resevoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Resevoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennet, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.H. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing And Other Enhancement On Solvent Aided Process", Journal of Canadian Petroleum Technology, vol. 46, No. 9, pp. 57-61, Sep. 2007.
United States Patent and Trademark Office, Non-final Office action issued U.S. Appl. No. 12/396,147, dated Mar. 28, 2011.
United States Patent and Trademark Office, Non-final Office action issued U.S. Appl. No. 12/396,284, dated Apr. 26, 2011.
Patent Cooperation Treaty, Notification of Transmittal of the International Search Report and The Written Opinion of the International Searching Authority, or the Declaration, in PCT/US2010,025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for

(56) References Cited

OTHER PUBLICATIONS

Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.
"Oil sands." Wikipedia, the free encyclopedia. Retrieved from the Internet from: http//en.wikipedia.org/w/index.php?title=Oil_sands &printable=yes, Feb. 16, 2009.
Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology A Review of Long Term R&D Opportunities." Jan. 31, 2005. LENEF Consulting (1994) Limited.
"Froth Flotation." Wikipedia, the free encyclopedia. Retrieved from the internet from: http//en.wikipedia.org/wiki/Froth_flotation, Apr. 7, 2009.
"Relative static permittivity." Wikipedia, the free encyclopedia. Retrieved from the Internet from http://en.wikipedia.org/w/index.php?title=Relative_static_permittivity&printable=yes, Feb. 12, 2009.
"Tailings." Wikipedia, the free encyclopedia. Retrieved from the Internet from http://en.wikipedia.org/w/index.php?title=Tailings &printable=yes, Feb. 12, 2009.
"Technologies for Enhanced Energy Recovery" Executive Summary, Radio Frequency Dielectric Heating Technologies for Conventional and Non-Conventional Hydrocarbon-Bearing Formulations, Quasar Energy LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrencce Livemore National Laboratory, Aug. 20, 2003, UCRL-ID-155045.
Sahni et al., "Electromagnetic Heating Methods for Heavy Oil Reservoirs," U.S. Department of Energy, Lawrence Livemore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livemore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC.
A. Godio: "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process For In Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.

* cited by examiner

APPARATUS AND METHOD FOR HEATING OF HYDROCARBON DEPOSITS BY RF DRIVEN COAXIAL SLEEVE

This specification is also related to the following applications, each of which is incorporated by reference herein: U.S. Ser. No. 12/396,284; U.S. Ser. No. 12/396,247; U.S. Ser. No. 12/396,192; U.S. Ser. No. 12/396,057; U.S. Ser. No. 12/396,021; U.S. Ser. No. 12/395,995; U.S. Ser. No. 12/395,953; U.S. Ser. No. 12/395,945; U.S. Ser. No. 12/395,918; U.S. Ser. No. 12/839,927; U.S. Ser. No. 12/903,684; U.S. Ser. No. 12/820,977; U.S. Ser. No. 12/835,331; and U.S. Ser. No. 12/886,338.

BACKGROUND OF THE INVENTION

The invention concerns heating of hydrocarbon materials in geological subsurface formations by radio frequency electromagnetic waves (RF), and more particularly, this invention provides a method and apparatus for heating hydrocarbon materials in geological formations by RF energy emitted by well casings that are coupled to an RF energy source.

Hydrocarbon materials that are too thick to flow for extraction from geologic deposits are often referred to as heavy oil, extra heavy oil and bitumen. These materials include oil sands deposits, shale deposits and carbonate deposits. Many of these deposits are typically found as naturally occurring mixtures of sand or clay and dense and viscous petroleum. Recently, due to depletion of the world's oil reserves, higher oil prices, and increases in demand, efforts have been made to extract and refine these types of petroleum ore as an alternative petroleum source.

Because of the high viscosity of heavy oil, extra heavy oil and bitumen, however, the drilling and refinement methods used in extracting standard crude oil are frequently not effective. Therefore, heavy oil, extra heavy oil and bitumen are typically extracted by strip mining of deposits that are near the surface. For deeper deposits wells must be used for extraction. In such wells, the deposits are heated so that hydrocarbon materials will flow for separation from other geologic materials and for extraction through the well. Alternatively, solvents are combined with hydrocarbon deposits so that the mixture can be pumped from the well. Heating with steam and use of solvents introduces material that must be subsequently removed from the extracted material thereby complicating and increasing the cost of extraction of hydrocarbons. In many regions there may be insufficient water resources to make the steam and steam heated wells can be impractical in permafrost due to unwanted melting of the frozen overburden. Hydrocarbon ores may have poor thermal conductivity so initiating the underground convection of steam may be difficult to accomplish.

Another known method of heating thick hydrocarbon material deposits around wells is heating by RF energy. Prior systems for heating subsurface heavy oil bearing formations by RF have generally relied on specially constructed and complex RF emitting structures that are positioned within a well. Prior RF heating of subsurface formations has typically been vertical dipole antennas that require specially constructed wells to transmit RF energy to the location at which that energy is emitted to surrounding hydrocarbon deposits. U.S. Pat. Nos. 4,140,179 and 4,508,168 disclose such prior dipole antennas positioned within vertical wells in subsurface deposits to heat those deposits. Arrays of dipole antennas have been used to heat subsurface formations. U.S. Pat. No. 4,196,329 discloses an array of dipole antennas that are driven out of phase to heat a subsurface formation. Prior systems for heating subsurface heavy oil bearing formations by RF energy have generally relied on specially constructed and complex RF emitting structures that are positioned within a well.

SUMMARY OF THE INVENTION

An aspect of the invention concerns an apparatus for heating a geologic deposit of material that is susceptible to heating by RF energy. The apparatus includes a source of RF power and a well structure that provides a closed electrical circuit to drive RF energy into the well.

Another aspect of the invention concerns heating a geologic deposit of material that is susceptible to heating by RF energy by an apparatus that is adapted to a well structure.

Yet another aspect of the invention concerns an apparatus for heating a geologic deposit of material that is susceptible to heating by RF energy that adapts conventional well configurations for transmission and radiation of RF energy.

DETAILED DESCRIPTION OF THE PREFERRED EMBODIMENTS

The present invention will be described more fully hereinafter with reference to the accompanying drawings, in which one or more embodiments of the invention are shown. This invention may, however, be embodied in many different forms and should not be construed as limited to the embodiments set forth herein. Rather, these embodiments are examples of the invention, which has the full scope indicated by the language of the claims. Like numbers refer to like elements throughout.

Figure 1:
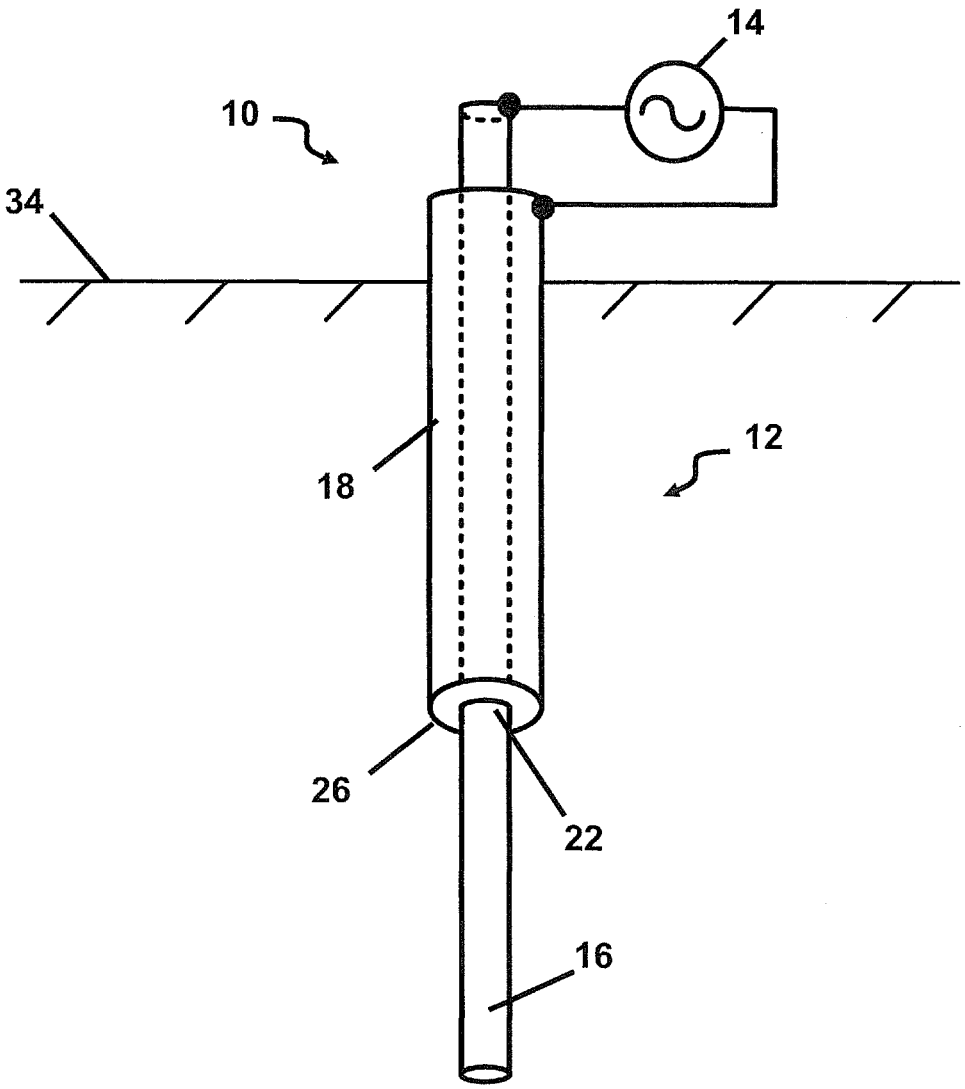
FIG. 1 illustrates an apparatus according to the present invention for emitting RF energy into a geologic hydrocarbon deposit.

FIG. 1 illustrates an apparatus 10 according to the present invention for driving an RF current in a well structure 12. The apparatus 10 includes an RF current source 14 that is coupled to the well structure 12 at two locations to create a circuit through the well structure. The well structure includes a bore pipe 16 of conductive material that extends into a geological formation through a surface 34. An electrically conductive sleeve 18 surrounds a section of the bore pipe 16 from the surface 34 to a location 22 along the length of the bore pipe 16. At the location 22, a conductive annular plate 26 extends from the bore pipe 16 to the sleeve 18 and is in conductive contact with both the pipe 16 and the sleeve 18. In FIG. 1 the well structure 12 is shown entirely vertical. It is understood however that well structure 12 may also be a bent well, such as a horizontal directional drilling (HOD) well. HOD wells can immerse antennas for long lengths in horizontally planar hydrocarbon ore strata.

Figure 2:
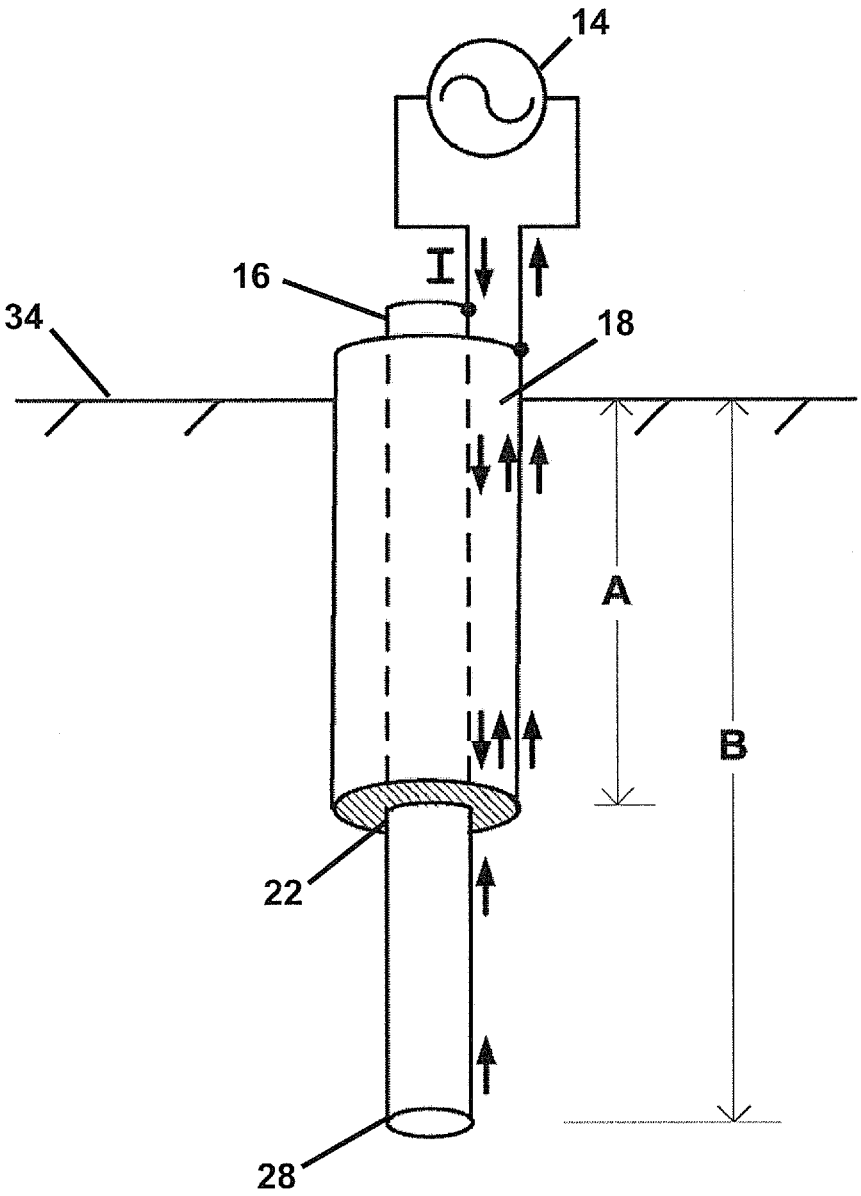
FIG. 2 illustrates the current conducted by the apparatus shown by FIG. 1.

A theory of operation for the FIG. 1 embodiment of the present invention is as follows. FIG. 2 illustrates the paths of RF currents I on the FIG. 1 embodiment from the RF current source 14 through the well structure 12. One terminal of the current source 14 is connected to the bore pipe 16 and the other terminal of the current source 14 to the sleeve 18 above the surface 34. As illustrated, multiple RF currents I travel on the surfaces of the bore pipe 16 and the sleeve 18. The thickness of the wall forming sleeve 18 is multiple radio frequency skin depths thick so electrical currents may flow in opposite directions on the inside of sleeve 18 and on the outside of bore pipe 16. It is believed that the currents inside the sleeve 18 do not flow through the inside of plate 26 due to the RF skin effect and magnetic skin effect. The well-antenna structure may comprise an end fed dipole antenna with an internal coaxial fold which provides an electrical driving discontinuity and a parallel resonating inductance from the internal coaxial stub.

Figure 3:
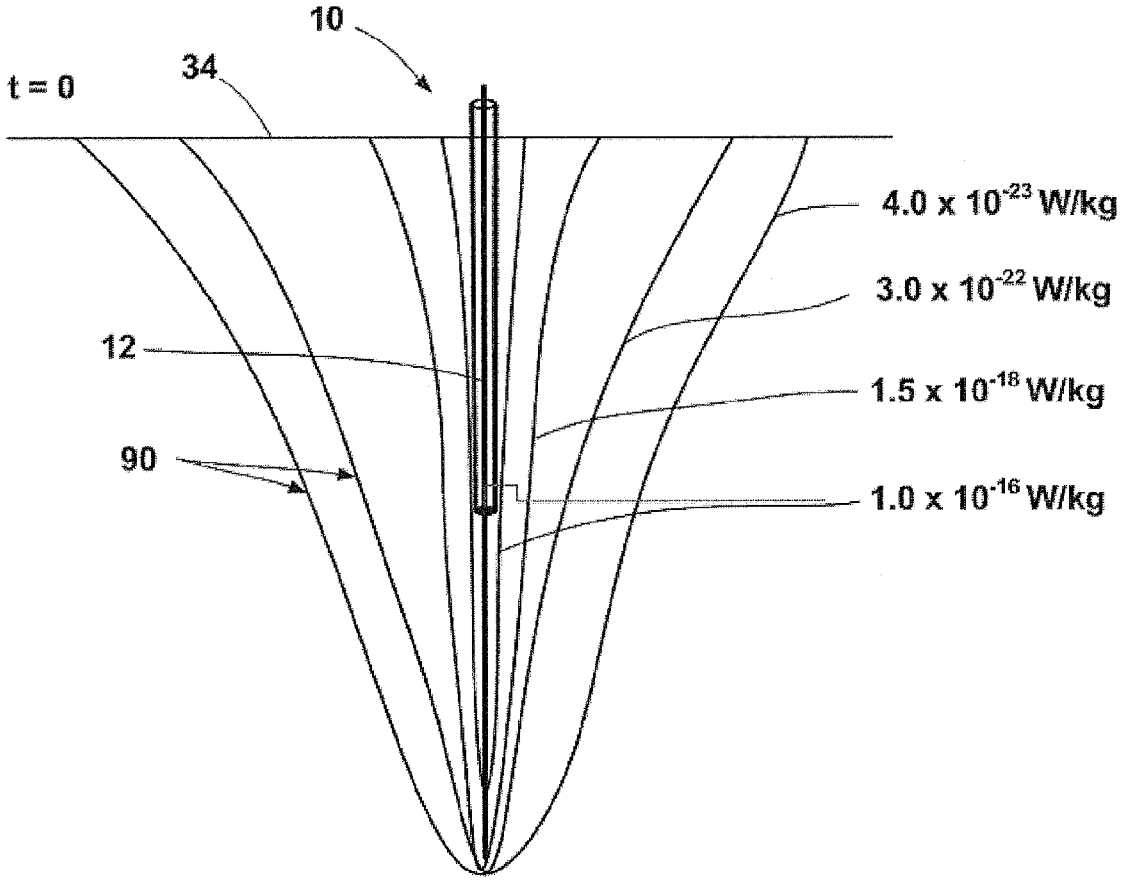
FIG. 3 illustrates heating of material surrounding the apparatus shown by FIG. 1 by specific absorption rate of the material.

The RF current in the bore pipe 16 and the sleeve 18 induces near field heating of the surrounding geologic material, primarily by heating of water in the material. The RF current creates eddy current in the conductive surrounding material resulting in Joule effect heating of the material. FIG. 3 depicts example heating contours 90 for the well 12. More specifically FIG. 3 shows the rate of heat application as the Specific Absorption Rate (SAR). SAR is a measure of the rate at which energy is absorbed by the underground materials when exposed to radio frequency electromagnetic fields. Thus FIG. 3 has parameters of power absorbed per power mass of material and the units are watts per kilogram (W/kg). The realized temperatures are a function of the duration of the heating in days and the applied power level in watts so most underground temperatures may be accomplished by the well 12. In the FIG. 3 example one (1) watt was applied to the well 12 at a frequency of 0.5 MHz. The time was t=0 or just when the electrical power was first applied. As can be appreciated there was heating along the entire length of the well pipe nearly instantaneously. The FIG. 3 embodiment is shown without an upper transmission line section, although one may be included if so desired. Thus the heating of the embodiment starts at the surface 34 which may preferential for say environmental remediation of spilled materials near the surface such as gasoline or methyl tertiary butyl ether (MTBE). By including a transmission line section (not shown in the FIG. 3 embodiment) heating near the surface is prevented to confine the heating to underground strata, such as a hydrocarbon ore.

A high temperature method of operation of the present invention will now be described. As the heating progresses over time a steam saturation zone can be formed along the well structure 12 and the realized temperatures limit along the well allowed to regulate at the boiling temperatures of the in situ water. This may range in practice from 100° C. at the surface to say 300° C. at depths. In this high temperature method the steam saturation zone grows longitudinally over time along the well and radially outward from the well over time extending the heating. There realized temperatures underground depend on the rate of heat application, which is the applied RF power in watts and the duration of the application RF power in days. Liquid water heats in the presence of RF electromagnetic fields so it is a RF heating susceptor. Water vapor is not a RF heating susceptor so the heating stops in regions where there is only steam and no liquid water is present. Thus, the steam saturation temperature is maintained in these nearby regions since when the water condenses to liquid phase it is reheated to steam.

A low temperature extraction method of the present invention will now be described. In this method the well structure 12 does not heat the underground resource to the steam saturation temperature (boiling point) of the in situ water, say to assist in hydrocarbon mobility in the reservoir. The technique of the method is to limit the rate of RF power application, e.g. the transmitter power in watts, and to allow the heat to propagate by conduction, convection or otherwise such that the realized temperatures in the hydrocarbon ore do not reach the boiling temperature of the in situ water. Thus the method is production of oil and water simultaneously at temperatures below the boiling point of the water such that the sand grains do not become coated with oil underground. As background, many hydrocarbon ores, such as Athabasca oil sand, frequently occur in a native state with a liquid water coating over sand grains followed by a bitumen film coating, e.g. the sand is coated with water rather than oil.

Frequently, the hydrocarbons that are to be extracted are located in regions that are separated from the surface. For such formations, heating of overburden geologic material surrounding a well structure near the surface is unnecessary and inefficient.

Figure 4:
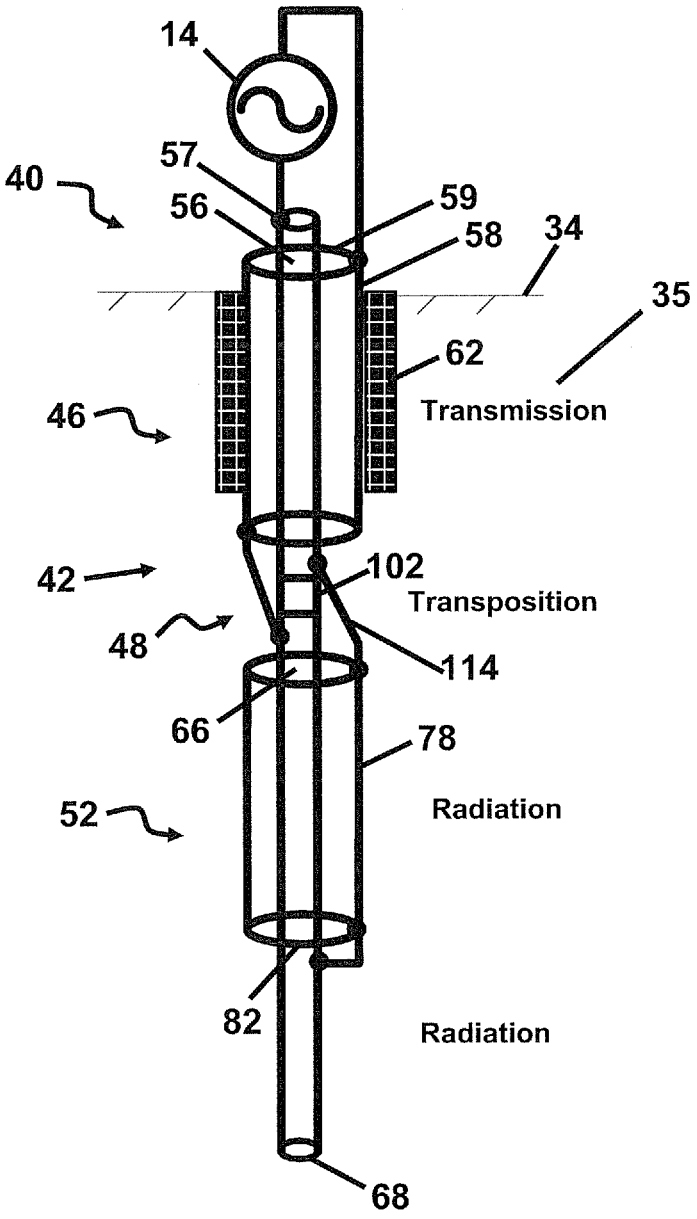
FIG. 4 illustrates an apparatus according to the present invention for emitting RF energy into a geologic hydrocarbon deposit having an apparatus that transmits RF energy to a structure that heats surrounding material by emitting RF energy.

FIG. 4 illustrates an apparatus 40 according to the invention for driving an RF current in a well structure 42 to heat geologic formations that are separated from the geological surface. The apparatus 40 includes an RF current source 14 that drives an RF current in the well structure 42 that extends into a geologic formation from a surface 34. The well structure 42 includes a transmission section 46 that extends along the well structure 42 from the surface 34 of the geological formation. The well structure also includes a transition section 48 that extends along the well structure 42 from the transmission section 46, and a radiation section 52 that extends along the well structure 42 from the transition section 48.

The transmission section 46 of the well structure 42 has a bore pipe 56 that extends along the well structure 42 from an upper end 57 to the transition section 48. A sleeve 58 surrounds the bore pipe 56 and extends along the bore pipe 56 from an upper end 59 to the transition section 48. The RF current source 14 connects to the bore pipe 56 and to the sleeve 58. The well structure 42 provides a circuit for RF current to flow as described below.

At the transition section 48, the bore pipe 56 is joined to a second bore pipe 66 and the sleeve 58 is joined to a second sleeve 78 that surrounds the second bore pipe 66 and extends along the second bore pipe 66 from the transition section 48. The connections at the transition section 48 are indicated schematically in FIG. 4, and are physically depicted in FIG. 5.

The second bore pipe 66 extends from the transition section 48 through the radiation section 52 to a lower end 68. A second sleeve 78 extends from the transition section 48 into the radiation section 52 around and along the second bore pipe to a location 82 that is between the transition section 48 and the lower end 68 of the bore pipe 66. At the location 82, the second sleeve 78 is conductively connected to the second bore pipe 66. This connection may be by annular plate 26 or other conductive connection.

Figure 5:
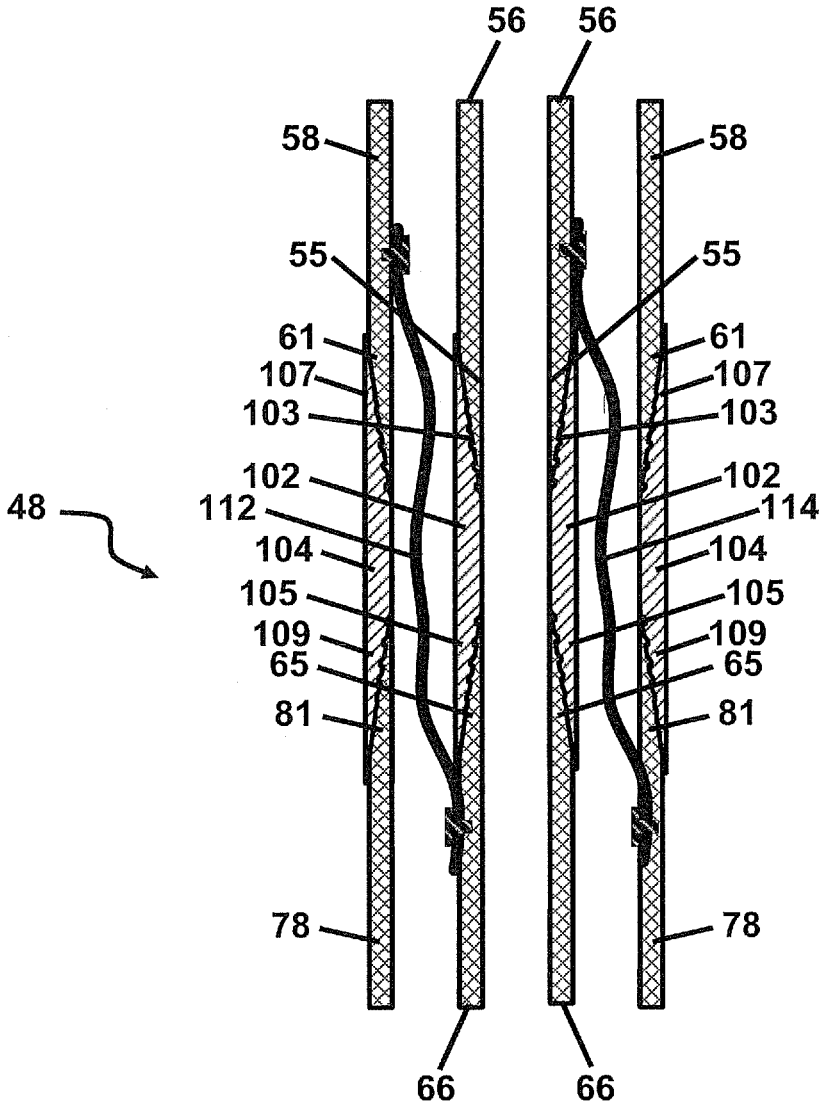
FIG. 5 illustrates a cross section of a region of the apparatus of FIG. 4 at which the apparatus transitions from transmission of RF energy to emission of RF energy.

FIG. 5 shows the cross section of the transition section 48. The bore pipe 56 ends at the transition section 48 with an externally threaded end 55. The bore pipe 66 has an externally threaded end 65 at the transition section 48. A nonconductive sleeve 102 is positioned between the externally threaded ends 55 and 65 of the bore pipes 56 and 66, respectively. The sleeve 102 has internally threaded ends 102 and 105 that engage the externally threaded ends 55 and 65, respectively, of the bore pipes 56 and 66, respectively. The sleeve 58 ends at the transition section 48 with an externally threaded end 61 and the sleeve 78 has an externally threaded end 81 at the transition section 48. A nonconductive sleeve 104 is positioned between the externally threaded ends 61 and 81 of the bore sleeves 58 and 78, respectively. The sleeve 104 has internally threaded ends 107 and 109 that engage the externally threaded ends 61 and 81, respectively, of the sleeves 58 and 78, respectively.

As illustrated by FIG. 5, a conductor 112 is fastened to and provides a conductive path between the sleeve 58 and the bore pipe 66. A conductor 114 is fastened to and provides a conductive path between the bore pipe 56 and the sleeve 78. As can be appreciated by comparison of the transmission section 52 of the well structure 42 to the well structure 12 shown by FIG. 1, transmission section 52 is configured and is driven by an RF current as is the well structure 12.

Figure 6:
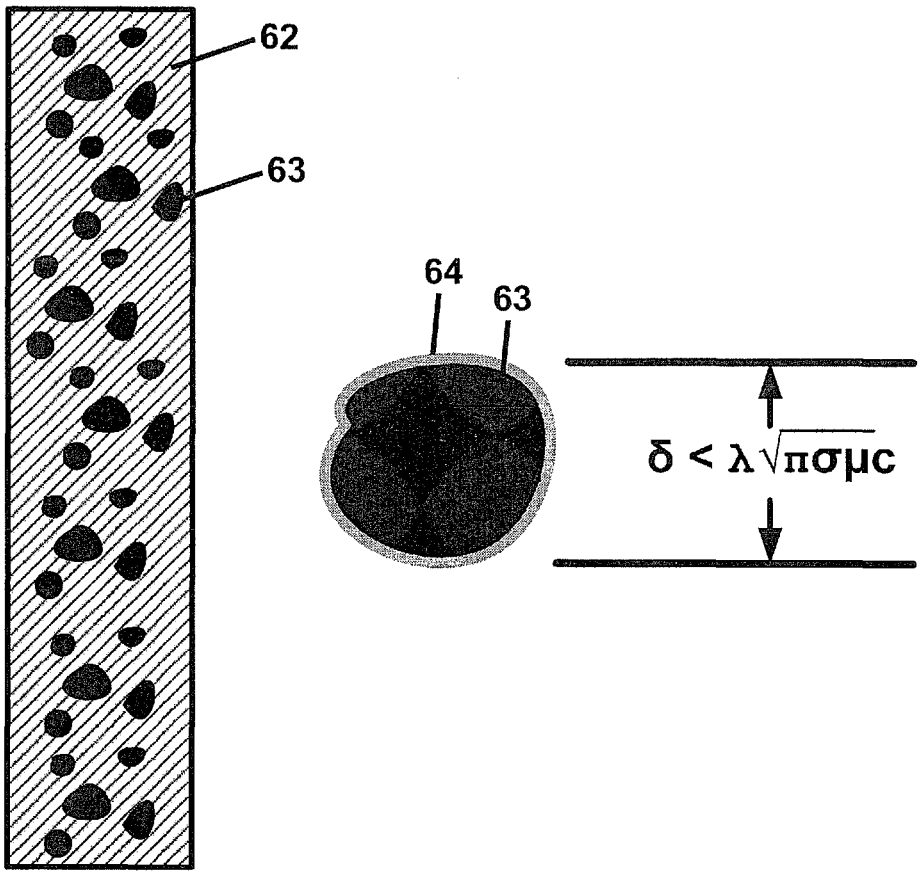
FIG. 6 illustrates a mixture of concrete and iron particles surrounding the transmission section of the apparatus of FIG. 4.
Figure 7:
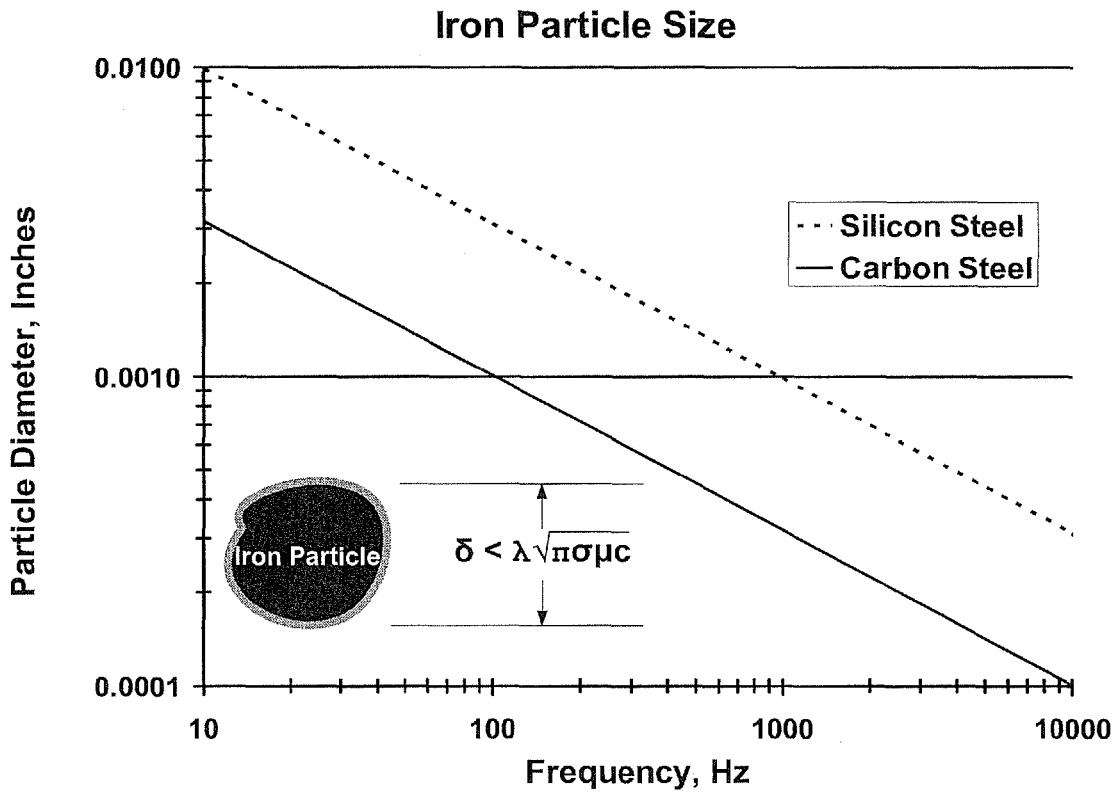
FIG. 7 illustrates the relationship between particle size and frequency to avoid inducing current in the particle.

Referring again to FIG. 4, a jacket 62 surrounds the sleeve 59 of the transmission section 46. The jacket 62 limits RF energy loss to the surrounding geologic material. FIG. 6 shows a partial cross section of the jacket 62. The jacket 62 is comprised of portland cement with iron particles 63 dispersed throughout. The iron particles 63 may have a passivation coating 64 on their exterior. The passivation coating 64 may be created by parkerizing by a phosphoric acid wash. The outer dimension of the iron particles is kept below a minimum dimension to prevent skin effect eddy currents from being induced by the RF energy that is conducted adjacent to the jacket 62. As indicated by FIG. 6, the outer dimension is less than $\lambda\sqrt{\pi\sigma\mu c}$ where $\lambda$ is the free space wavelength in meters, $\sigma$ is the electrical conductivity of the iron in mhos or siemens, $\mu$ is the magnetic permeability on henries per meter and c is the speed of light in meters per second. FIG. 7 shows the diameter of particles 63 for both carbon steel and silicon steel particles for frequency between 10 Hz and 10,000 HZ.

The well structure 42 as shown by FIG. 4 will create a heating pattern as shown by FIG. 3 that is adjacent to the transmission region 52. The location of that heating region can be specified by the length of the transmission region so that the region of RF heating is at a desired depth below the surface.

The present invention is capable of electromagnetic near field heating. In near field antenna operation in dissipative media the field penetration is determined both by expansion spreading and by the dissipation. Field expansion alone provides for a $1/r^2$ rolloff of electromagnetic energy radially from the well axis. Dissipation can provide a much steeper gradient in heating applications and between $1/r^5$ and $1/r^7$ are typical for oil sands, the steeper gradient being typical of the leaner, more conductive ores. The t=0 initial axial penetration of the heating along the well-antenna may be approximately 2 RF skin depths. The RF skin depth is exact for far fields/the penetration of radio waves and approximate for near fields. As the present invention is immersed in the ore and initially not in a cavity the wave expansion is typically inhibited. A steam saturation zone (steam bubble) may grow along the present invention antenna and this spreads the depth of the heating over time to that desired as the fields can expand in the low loss volume of the steam bubble to reach the bubble wall where the in situ liquid water is in the unheated ore and the heating can be concentrated there. The steam bubble around the antenna may comprise a region primarily composed of water vapor, sand, and some residual hydrocarbons. The electrically conductivity and imaginary component dielectric permittivity are relatively low in the steam bubble saturation zone so electromagnetic energy can pass through it without significant dissipation.

I claim:

1. An apparatus for heating hydrocarbon material in a subsurface formation from a wellbore comprising:
- a first conductive element having first and second ends, and a connection location therebetween;
- a first conductive sleeve surrounding said first conductive element between the first end and the connection location thereof and so that said first conductive element extends outwardly beyond said first conductive sleeve;
- a conductive connection conductively joining said first conductive sleeve to said first conductive element at the connection location; and
- an RF power source coupled to said first conductive element and said first conductive sleeve to provide RF current therethrough so that said first conductive element and said first conductive sleeve are configured as a dipole antenna for inducing electromagnetic near field heating of the surrounding subsurface formation.

2. The apparatus according to claim 1 wherein said first conductive element comprises a pipe.

3. The apparatus according to claim 1 wherein said first conductive element, said first conductive sleeve and said conductive connection are configured as a radiation section; and further comprising:
- a transmission section coupled to said RF power source; and
- a transition section coupled between said transmission section and said radiation section.

4. The apparatus according to claim 3 wherein said transmission section comprises a second conductive element having first and second ends; and a second conductive sleeve surrounding said second conductive element between the first and second ends thereof.

5. The apparatus according to claim 4 wherein said transition section comprises:
- an inner non-conductive sleeve coupled between the second end of said first conductive element and the first end of said second conductive element;
- an outer non-conductive sleeve coupled between said first conductive sleeve and said second conductive sleeve;
- a first conductive path coupled between said first conductive sleeve and said second conductive element; and
- a second conductive path coupled between said first conductive element and said second conductive sleeve.

6. The apparatus according to claim 5 wherein said inner non-conductive sleeve is coupled to the second end of said first conductive element via a threaded interface and to the first end of said second conductive element via a threaded interface; and wherein said outer non-conductive sleeve is coupled to said first conductive sleeve via a threaded interface and to said second conductive sleeve via a threaded interface.

7. The apparatus according to claim 3 wherein said transition section comprises:
- at least one non-conductive sleeve coupled between said transmission section and said radiation section; and
- at least one conductive path coupled between said transmission section and said radiation section.

8. The apparatus according to claim 4 further comprising a jacket surrounding said second conductive sleeve.

9. The apparatus according to claim 8 wherein said jacket comprises a mixture of portland cement and iron particles.

10. An apparatus for heating hydrocarbon material in a subsurface formation from a wellbore comprising:
- an RF power source;

a transmission section coupled to said RF power source;

a transition section coupled to said transmission section; and a radiation section coupled to said transition section and comprising a first conductive element having first and second ends, and a connection location therebetween, a first conductive sleeve surrounding said first conductive element between the first end and the connection location thereof and so that said first conductive element extends outwardly beyond said first conductive sleeve, a conductive connection conductively joining said first conductive sleeve to said first conductive element at the connection location, and said RF power source providing RF current so that said first conductive element and said first conductive sleeve are configured as a dipole antenna for inducing electromagnetic near field heating of the surrounding subsurface formation.

11. The apparatus according to claim 10 wherein said first conductive element comprises a pipe.

12. The apparatus according to claim 10 wherein said transmission section comprises a second conductive element having first and second ends; and a second conductive sleeve surrounding said second conductive element between the first and second ends thereof.

13. The apparatus according to claim 12 wherein said RF power source is coupled to the first end of said second conductive element.

14. The apparatus according to claim 10 wherein said transition section comprises:

an inner non-conductive sleeve coupled between the second end of said first conductive element and the first end of said second conductive element;

an outer non-conductive sleeve coupled between said first conductive sleeve and said second conductive sleeve;

a first conductive path coupled between said first conductive sleeve and said second conductive element; and a second conductive path coupled between said first conductive element and said second conductive sleeve.

15. The apparatus according to claim 14 wherein said inner non-conductive sleeve is coupled to the second end of said first conductive element via a threaded interface and to the first end of said second conductive element via a threaded interface; and wherein said outer non-conductive sleeve is coupled to said first conductive sleeve via a threaded interface and to said second conductive sleeve via a threaded interface.

16. The apparatus according to claim 10 wherein said transition section comprises:

at least one non-conductive sleeve coupled between said transmission section and said radiation section; and at least one conductive path coupled between said transmission section and said radiation section.

17. The apparatus according to claim 12 further comprising a jacket surrounding said second conductive sleeve.

18. The apparatus according to claim 17 wherein said jacket comprises a mixture of portland cement and iron particles.

19. A method for heating hydrocarbon material in a subsurface formation from a wellbore comprising:

positioning a first conductive element in the subsurface formation, the first conductive element having first and second ends, and a connection location therebetween;

providing a first conductive sleeve surrounding the first conductive element between the first end and the connection location thereof and so that the first conductive element extends outwardly beyond the first conductive sleeve;

providing a conductive connection conductively joining the first conductive sleeve to the first conductive element at the connection location; and operating an RF power source coupled to the first conductive element and the first conductive sleeve to provide RF current therethrough so that the first conductive element and the first conductive sleeve are configured as a dipole antenna for inducing electromagnetic near field heating of the surrounding subsurface formation.

20. The method according to claim 19 wherein the first conductive element comprises a pipe.

21. The method according to claim 19 wherein the first conductive element, the first conductive sleeve and the conductive connection are configured as a radiation section; and further comprising:

positioning a transmission section in the subsurface formation, with the transmission section coupled to the RF power source; and providing a transition section coupled between the transmission section and the radiation section.

22. The method according to claim 21 wherein the transmission section comprises a second conductive element having first and second ends; and a second conductive sleeve surrounding the second conductive element between the first and second ends thereof.

23. The method according to claim 22 wherein the RF power source is coupled to the first end of the first conductive element.

24. The method according to claim 22 wherein the transition section comprises:

an inner non-conductive sleeve coupled between the second end of the first conductive element and the first end of the second conductive element;

an outer non-conductive sleeve coupled between the first conductive sleeve and the second conductive sleeve;

a first conductive path coupled between the first conductive sleeve and the second conductive element; and a second conductive path coupled between the first conductive element and the second conductive sleeve.

25. The method according to claim 22 wherein the inner non-conductive sleeve is coupled to the second end of the first conductive element via a threaded interface and to the first end of the second conductive element via a threaded interface; and wherein the outer non-conductive sleeve is coupled to the first conductive sleeve via a threaded interface and to the second conductive sleeve via a threaded interface.

26. The method according to claim 21 wherein the transition section comprises:

at least one non-conductive sleeve coupled between the transmission section and the radiation section; and at least one conductive path coupled between the transmission section and the radiation section.

27. The method according to claim 22 further providing a jacket surrounding the second conductive sleeve, with the jacket comprising a mixture of portland cement and iron particles.

* * * * *